US008801866B1

(12) United States Patent
Arafat et al.

(10) Patent No.: US 8,801,866 B1
(45) Date of Patent: Aug. 12, 2014

(54) COMPOSITION AND METHOD FOR CLEANING AND REMOVING OLEAGINOUS MATERIALS FROM COMPOSITES

(71) Applicants: El Sayed Arafat, Leonardtown, MD (US); Dane Hanson, California, MD (US); Raymond Meilunas, Lexington Park, MD (US)

(72) Inventors: El Sayed Arafat, Leonardtown, MD (US); Dane Hanson, California, MD (US); Raymond Meilunas, Lexington Park, MD (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/895,720

(22) Filed: May 16, 2013

(51) Int. Cl.
*B08B 3/04* (2006.01)

(52) U.S. Cl.
USPC ..... 134/39; 134/40; 134/42; 510/102; 510/183; 510/188; 510/199; 510/213; 510/242; 510/251; 510/255; 510/258; 510/271; 510/499

(58) Field of Classification Search
CPC ..... C11D 7/242; C11D 7/244; C11D 7/247; C11D 7/248; B08B 3/04
USPC ..... 510/102, 183, 188, 199, 213, 242, 251, 510/255, 258, 271, 499; 134/39, 40, 42
See application file for complete search history.

(56) References Cited

U.S. PATENT DOCUMENTS

| | | | | |
|---|---|---|---|---|
| 3,933,674 | A | 1/1976 | Farnsworth | |
| 4,336,151 | A | 6/1982 | Like | |
| 4,414,128 | A | 11/1983 | Goffinet | |
| 4,533,487 | A | 8/1985 | Jones | |
| 5,691,289 | A | 11/1997 | Purcell | |
| 5,958,857 | A * | 9/1999 | Bevilacqua et al. | 510/245 |

* cited by examiner

*Primary Examiner* — Brian P Mruk
(74) *Attorney, Agent, or Firm* — Mark O. Glut; NAWCAD

(57) ABSTRACT

A non-aqueous solvent composition and method for cleaning and removing oleaginous materials such as hydraulic fluids from reinforced-fiber composites characterized as a cleaning composition free of ozone depletion materials, having a low vapor pressure, a flash point above 140° F., and consists essentially of cyclohexenes, isoparaffinic hydrocarbons, dearomatized hydrocarbons and corrosion inhibitors.

19 Claims, 2 Drawing Sheets

FIG−1

COMPOSITION AND METHOD FOR CLEANING AND REMOVING OLEAGINOUS MATERIALS FROM COMPOSITES

STATEMENT OF GOVERNMENT INTEREST

The invention described herein may be manufactured and used by or for the Government of the United States of America for government purposes without the payment of any royalties thereon or therefore.

BACKGROUND OF THE INVENTION

This invention relates to compositions and methods for cleaning and removing oleaginous materials from reinforced fiber composites. The proximity of aircraft landing gear doors and horizontal stabilizers to hydraulic fluid (HF) reservoirs leaves composite parts vulnerable to fluid contamination. As aircraft age, this problem is exacerbated, as damaged reservoirs and lines leak operational fluids into open regions, particularly core cells of composite honeycomb. While the majority of these oleaginous fluids are not inherently damaging to the structural materials, residual fluids interfere with bonded patch repair. Without a consistent method to effectively remove hydraulic fluid contamination to enable reliable bonded repairs, repairing the contaminated parts will not be achievable.

The traditional method to remove hydraulic fluid contamination prior to the application of the bonded composite repair patch involves packing the contaminated area with breather cloth and heating at an elevated temperature under vacuum. The current procedure for removing hydraulic fluids from composite materials is costly and time consuming. Methyl-isobutyl ketone (MIBK) is used to remove hydraulic fluid from most composite materials. MIBK is ineffective in the removal of hydraulic fluid from composite materials; however, it has been used because it does not pose a threat to the workers. Due to the limited number of controlled environments to perform this process while aircraft are deployed, it is necessary to use solvents that are environmentally friendly and present minimum risk to workers.

More specifically, aircraft composite structures often become contaminated by various aircraft maintenance fluids during the course of normal operation. For example, hydraulic fluid contamination can cause composite plasticization, delamination and disbanding from honeycomb core. Additionally, hydraulic fluid contamination must be addressed prior to a bonded repair. The solvent of choice for cleaning composite structures has historically been hexane, which efficiently removes hydraulic fluid contamination without adversely affecting composite properties. However, hexane is a hazardous chemical with a low flash point and must be used in a controlled environment to prevent worker exposure. Therefore, any new cleaner must be environmentally-advantaged, less hazardous, and most importantly, must be effective in removing the hydraulic fluid from the composite materials without affecting their mechanical and thermal properties.

Figure 1:
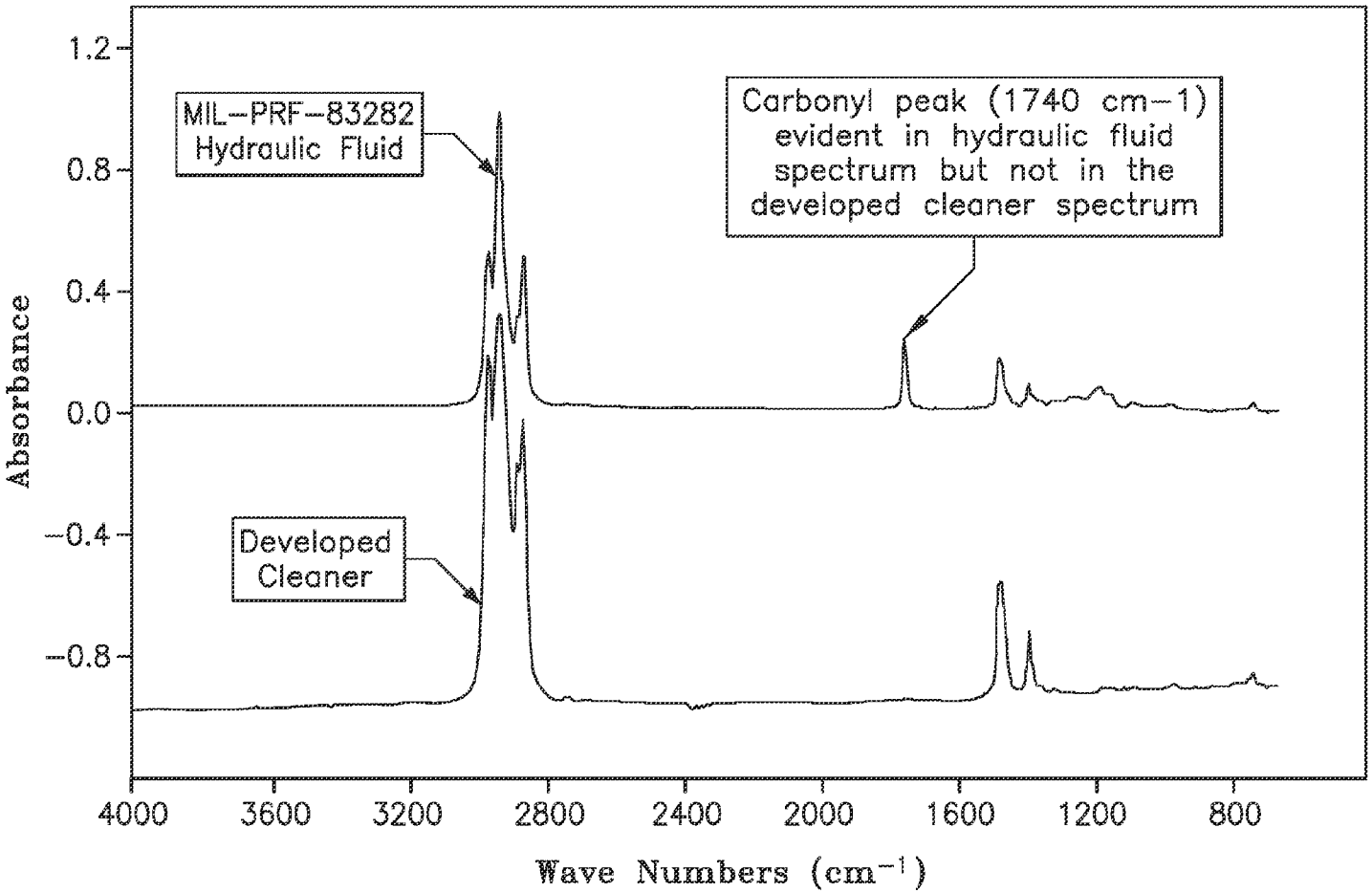
FIG. 1: Infrared spectra for MIL-PRF-83282 hydraulic fluid and standard hydrocarbon solvent showing the spectral differences in the 1740 $cm^{-1}$ carbonyl stretch vibration region.

Accordingly, it is an object of this invention to provide a non-aqueous fluid composition for cleaning and removing oleaginous materials such as hydraulic fluids from reinforced fiber composites.

It is another object of this invention to provide a method of cleaning and removing oleaginous materials from reinforced graphite fiber composites with a non-aqueous fluid composition characterized as being free of ozone depletion materials, having a low vapor pressure, and a flash point above 140° F.

SUMMARY OF THE INVENTION

This invention is focused on optimizing a mixture of specific organic solvents as a cleaner for removing oleaginous materials such as hydraulic fluids from composites effectively and safely. Several non-aqueous solvent blends have been developed to remove hydraulic fluid from composite materials; these blends are less hazardous and are not regulated as hazardous air pollutant (HAPs). Composite materials were soaked in hydraulic fluid and then rinsed with the developed cleaners to remove the fluid. Infrared (IR) spectroscopy was used to measure the effectiveness of the developed cleaners. The results have shown that the developed cleaner of this invention is more efficient than the control materials. In addition to the cleaning efficiency, the effect on the mechanical properties of the composite materials i.e. reinforced graphite fiber (IM7/977-3) was conducted. The IM7/977-3 composite laminate showed no degradation in flexural and short beam shear strength after a 1-hour soak in the solvent blend of this invention (Form 4.2).

DETAILED DESCRIPTION

This invention was focused on optimizing/blending aliphatic and aromatic solvents to form effective cleaners that are capable of removing oleaginous materials such as hydraulic fluids from composite materials effectively and safely. This effort will lead to increased understanding of the physical and chemical properties of cleaning solvents that are capable of decontaminating composite materials safely and effectively. This invention will benefit the Naval Aviation Enterprise (NAE) by providing a more efficient, cost effective and environmentally acceptable means to clean critical composite weapons system components of oleaginous fluids such as hydraulic fluid. The cost savings will be realized through reduced maintenance costs, complying with the environmental regulations and enhanced mission readiness.

Description and Operation

Although various operational oleaginous fluids intrude into composite skin and honeycomb based structure on aircraft, hydraulic fluid was deemed to be the most significant in affecting the bond-line in bonded repairs and the most persistent in the maintenance environment. Specifically, usage of MIL-PRF-83282 hydraulic fluid was identified as more widespread than of products according to other specifications. To address the removal of hydraulic fluid from a polarity and solvency stand-point, a consideration of the constituents of the fluid was made. Table I lists the composition of a representative hydraulic fluid qualified to MIL-PRF-83282 and includes a description and polarity of the components. Since the hydraulic fluid to be removed consists of both polar and non-polar compounds, a solvent system is unlikely to effectively remove all of the components in the hydraulic fluid. For that reason, a mixture of solvents or solvent blend was used to complete the decontamination of the composite. As a measure of solvency, the Kauri-butanol (Kb) values of the pure solvents were first considered before the down-select.

TABLE I

Description of the components of MIL-PRF-83282 hydraulic fluid

| Component | Descriptive/Polarity |
|---|---|
| Poly-alpha-olefin (PAO) | Synthetic Hydrocarbon/NP |
| Diisooctyl Adipate | Synthetic Ester/P |
| Tricresyl Phosphate | Phosphate Ester Antiwear Additive/P |
| Ethanox 4702 | Phenolic Antioxidant/P |
| Benzotriazole | Corrosion Inhibitor/P |
| Oil Red 235 | Oil Soluble Red Dye |

To formulate an effective and environmentally-friendly cleaner, the properties of the optimized cleaner must be defined. The properties of the formulated cleaner of this invention are the following: (1) HAP-free (Hazardous Air Pollutant) and low odor; (2) low vapor pressure; (3) free of Ozone-Depleting Substances (ODS); (3) flash point above 140° F. (60° C.); (4) compatible with metals and non-metals; (5) high cleaning efficiency; and safe to use. Based on these criteria, the initial candidates for use in the solvent blend were identified.

Table 2 lists the control materials, the initial materials considered, and the final, optimum formulation along with the properties considered. It should be noted that all solvents considered are HAP-free and ODS-free, while the last five are VOC-exempt.

Composition of the Cleaner Formulation of this Invention (Form 4.2)

PARTS BY WEIGHT

| | | | |
|---|---|---|---|
| 1) | Isopar L Solvent (Isoparaffinic Hydrocarbon) | 49 | 45 to 55 (48 to 50) |
| 2) | Exxsol D60 Solvent (Dearomatized Hydrocarbons) | 49 | 45 to 55 (48 to 50) |
| 3) | D-Limonene (Cyclohexene) | 2 | 1.0 to 3.0 (1.5 to 2.5) |
| 4) | Corrosion Inhibitors | 0.0 to 3.0<br>0.5 to 1.0 | 0.0 to 5.0 (1.0 to 3.0) |

PARTS BY WEIGHT

1) Isopar L Solvent 49 45 to 55 (48 to 50)
(Isoparaffinic Hydrocarbon)
2) Exxsol D60 Solvent 49 45 to 55 (48 to 50)
(Dearomatized Hydrocarbons)
3) D-Limonene (Cyclohexene) 2 1.0 to 3.0 (1.5 to 2.5)
4) Corrosion Inhibitors 0.0 to 3.0 0.0 to 5.0 (1.0 to 3.0) 0.5 to 1.0

The corrosion inhibitor is selected from the group consisting of benzimidazole, benzothiazole, benzoxazole, diphenyltriazole, benzotriazole and tolylazole. The cleaning solvents are selected depending on the chemistry of the fiber composites so that the selected solvents will not adversely affect the mechanical or thermal properties of the composite.

Lab Scale Vacuum Assisted Solvent Cleaning (VASC) Process Development

The premise of the VASC process is that a pathway must exist from the outer surface of sandwich structure, i.e. the composite to the interior core cells for the cells to fill with an oleaginous material such as hydraulic fluid. This conduit could be a small crack, hole, or disband between the core and composite skin. This same pathway potentially can be used to inject the solvent or cleaner of this invention into the cells to dissolve the hydraulic fluid followed by flushing the solvent/hydraulic fluid mixture out of the cell. Submerging a hydraulic fluid contaminated sandwich structure in a vat of solvent would not necessarily result in the cleaner reaching all the cells as air pockets could restrict fluid flow. Specifically, the preferred VASC process comprises the following five general steps:

1. Evacuate the composite (via vacuum bag as an example) to remove air from interior honeycomb core cells (30 inches of Hg).
2. Introduce the solvent of this invention to the composite under the sealed vacuum (5 inches of Hg).
3. Mix the solvent with hydraulic fluid by agitation or rotation of composite.
4. Remove the solvent and hydraulic mixture from composite by vacuuming (25 inches of Hg).
5. Remove the composite part from the vacuum and dry in air at about 200° F. for about 24 hours.

By first placing the fiber composite under vacuum, one removes the entrained air in the cracks and cells. If next, the cleaner is introduced into the system, the vacuum would rapidly be replaced by the cleaner up to the interface with the entrained hydraulic fluid. Agitating the composite causes the cleaner to mix/dissolve with the hydraulic fluid. Finally, a partial vacuum is again applied to the composite to evacuate the solvent/hydraulic fluid mixture out of the core cells.

Description of Setup

To test the proposed cleaning approach, a small scale lab set up was assembled utilizing components and materials typically found in a composite processing or repair shop. Aluminum (Al) foil based bagging film (typically used to vacuum bag composite prepreg) is used to construct a vacuum bag around the 6"×6" honeycomb test pieces. One side of the Al foil has a thermoplastic film which allows the quick formation of a vacuum seal via a heated iron. Teflon tubing (¼" diameter) is used to produce input and exit ports on the vacuum bag. Two shut-off valves are connected to the input and exit tubing. The exit tubing is connected to a Ventura vacuum pump. A solvent (cleaner) trap is placed between the vacuum pump and the vacuum bag to collect the solvent mixture rinsed through the test article so it does not reach the pump. A simple beaker is used for the solvent source/reservoir.

Vacuum Assisted Solvent Cleaning Procedure (VASC)

Purpose: To remove hydraulic fluid from 6"×6" sections cut from H-53 Work Platform.

1. The four side faces of the sections were drilled with a $\frac{1}{8}^{th}$ inch drill bit to a depth 1.5 inches, 8 times: two holes evenly spaced on each of the four sides.
2. 6" by 6" sections were soaked for two weeks in hydraulic fluid.
3. Weights were taken after the fluid was drained and the panel has dried.
4. A piece of 181 fiberglass was cut so that the section is completely wrapped, with one inch extra hanging over on two opposite sides so that vacuum tubes can later be attached.
5. Air Weave N10FR breather cloth next was wrapped around the fiberglass wrapped section, with one inch overhanging on each side so that the input and exit tubes could be installed.
6. The wrapped door was placed on a sheet of envelope bag film, and double sided sealant tape was placed on the envelope bag film around the perimeter of the section.
7. The input tube was placed on the right, with the tube placed near the drilled holes so that the main vacuum suction was in close proximity. In the same way, the exit tube was placed on the left. These tubes were fastened into place by additional sections of double-sided tape.
8. The rest of the envelope bag film was folded over the wrapped section and pressed against the tape so that a sealed off vessel was created.
9. The vessel was attached to the vacuum and was confirmed to be airtight.

10. The vessel was tilted to facilitate the movement of fluids. The tilt was near 45° with the exit tube elevated.

11. 550 mL of rinse solution was measured into a beaker. The open end of the input tube was placed in the beaker so that the vacuum would no longer pull in air, but would now pull the rinse solution through the apparatus via vacuum. A vacuum of 5 inches of Hg was used. Not all 550 mL of solution was injected into the vacuum bag; just enough to fill the bag. The sample was known to be fully immersed in the solution by the saturation of the Air Weave N10FR breather cloth up to the edge of the vacuum bag/exit port. The exact amounts of solution initially injected into the bag, removed from the bag, and that remained in the bag/section are given in Table 14.

12. Once the vacuum bag was filled with cleaner, the exit valve was partially opened and the input valve was closed so that a partial vacuum was held on the section, yet no fluid was moving. This vacuum state was held for 15 minutes so that the rinse solution could dissolve the hydraulic fluid. The pressure was then increased to 25+inches of Hg. Once the pressure was changed, the input and exit valves were both opened so that the rinse solution could be removed. All of the fluid was allowed to drain out in 10 minutes. The process of draining consisted of closing the input valve for enough time to allow the vacuum to build inside the door and then opening the valve so that the built up vacuum would force the fluid into the collecting flask. Tilting the sample towards the exit valve helped remove excess fluid.

13. The flask was removed from the vacuum apparatus and the collected effluent was poured into a separate container. The volumes collected are given in Table 15.

14. The envelope bag was opened and the sample was removed. The envelope bag reseals for minimal spilling of residual effluent.

15. The collecting flask was rinsed out with rinse solution, so any residual hydraulic fluid would not affect the analysis of the next rinse cycle.

16. Isopropyl Alcohol was used to clean off the ends of the tubes so that they would have a clean surface onto which the sealant tape could adhere for the next rinse cycle.

17. The sample was placed upright on a sheet of Air Weave breather cloth and more cleaner/hydraulic fluid mixture drained.

18. This procedure was repeated four times with hydraulic fluid cleaner and four times using NAVSOLVE.

19. After running the collected hydraulic fluid cleaner through an FTIR, the presence of hydraulic fluid was confirmed, and the concentration of hydraulic fluid was shown to decrease from rinse one to four. Note: On the third and fourth NavSolve rinses, it was suggested that the soak time be increased from 15 minutes to 30 minutes. The vacuum was used to keep the NavSolve moving during soak times on these last two rinses.

TABLE 14

Volume Exchanges Using Hydraulic Fluid Cleaner (VASC)

| Test # | Amount of rinse solution taken into the door | Amount of solution recovered from door | Amount left in the envelope bag |
|---|---|---|---|
| Rinse 1 | 425 mL | 365 mL | 60 mL |
| Rinse 2 | 490 mL | 425 mL | 65 mL |
| Rinse 3 | 450 mL | 385 mL | 65 mL |
| Rinse 4 | 490 mL | 440 mL | 50 mL |

TABLE 15

Volume Exchanges Using NavSolve (VASC)

| Test # | Amount of rinse solution taken into the door | Amount of solution recovered from the door | Amount left in the envelope bag |
|---|---|---|---|
| Rinse 1 | 450 mL | 405 mL | 45 mL |
| Rinse 2 | 450 mL | 380 mL | 70 mL |
| Rinse 3 | 500 mL | 460 mL | 40 mL |
| Rinse 4 | 450 mL | 405 mL | 45 mL |

INGREDIENT RESOURCES

Isopar L. Solvent (Isoparaffinic Hydrocarbons)
Exxonmobil Chemical Company
P.O. Box 3272
Houston, Tex. 77253-3272

Exxsol D60 Solvent (Dearomatized Hydrocarbons)
Exxonmobil Chemical Company
P.O. Box 3272
Houston, Tex. 77253-3272

D-Limonene (Cyclohexene $C_{10}H_{16}$), 1-methyl-4-(1-methyl-ethenyl)
Florida Chemical Company
351 Winter Haven Blvd., NE
Winter Haven, Fla. 33881-9432

Properties of the Hydraulic Fluid Cleaner

The cleaning efficiency test results for the formulation of this invention (Formula 4.2) and the effect of the inventive formulation on the mechanical properties of fiber composites are shown in Table 2.

Cleaning Efficiency

The neat and formulated solvents were screened to be able to meet several initial criteria before being subjected to the more-intensive material compatibility testing. These initial criteria were prioritized because they pertain to assuring the suitability of the cleaner and, the ability to effectively and efficiently decontaminate the surface. The selected solvents and formulations for testing and evaluation which include solvent ingredients (Base series), formulation blends (Form series) and control solvents (Hexane and MIBK) are listed in Table 3.

TABLE 2

Testing results of the new hydraulic fluid cleaner formulation (Form 4.2) compared to the current cleaners (controls)

| TEST | Test method | Hexane (Control) | MIBK (Control) | New Formulation (Form 4.2) |
|---|---|---|---|---|
| Cleaning Efficiency | | | | |
| Gravimetric Immersion Cleaning (%) | MIL-PRF-32295A | 92.2% | 98.7% | 96.2% |
| Wipe Cleaning (Cycle) | FT-IR | 3 Cycles | 5 Cycles | 2 Cycles |
| Composite Immersion Cleaning (%) | MIL-PRF-32295A | 94.8% | 97.1% | 99.5% |
| Flash Point (F.) | ASTM D93 | −15 F. | 57 F. | 141 F. |
| Drying Time at 120 F. (10 minutes/Cycle | MIL-PRF-32295A | 1 | 1 | 4 |
| Residual Surface Contaminants | | | | |
| Tape Peel Adhesion Test (lb ft/in) | ASTM D3330M02 | 10.01 | 11.38 | 10.48 |

TABLE 2-continued

Testing results of the new hydraulic fluid cleaner formulation (Form 4.2) compared to the current cleaners (controls)

| TEST | Test method | Hexane (Control) | MIBK (Control) | New Formulation (Form 4.2) |
|---|---|---|---|---|
| Compression Lap shear Testing, sanded panels (psi) | ASTM D3846 | N/A | N/A | 6580 psi |
| Material Compatibility | | | | |
| Flexural Strength Testing, three weeks exposure (ksi) | ASTM D790 | 136.5 ksi | 139.7 ksi | 136.8 ksi |
| Short Beam Shear Strength Testing, three weeks exposure (ksi) | ASTM D2344 | 7.3 ksi | 7.6 ksi | 7.2 ksi |

TABLE 3

Selected Solvents and Blended Formulations for Testing and Evaluation

| Condition | Flash Point (° F.) |
|---|---|
| Hydraulic Fluid | 401 |
| Hexane | −15 |
| MIBK | 57 |
| Base 2 | 144 |
| Form 2.1 | NA |
| Base 3 | 143 |
| Form 3.1 | NA |
| Form 4.1 | NA |
| Form 4.2 | 141 |

The IM7/977-3 structural composite system was chosen for this study as it is the main aerospace grade composite material utilized in both primary and secondary structure on several naval aircraft such as the F/A-18 and F-35. IM7/977-3, the composite is composed of graphite-fiber reinforcements (IM7) in a toughened epoxy-based polymer matrix (977-3). To measure the effectiveness of the developed formulations, three cleaning techniques were used for removing hydraulic fluid from composite materials as described herein.

Method 1—Gravimetric Immersion Cleaning

Previous experience investigating a test method to measure cleaning efficiency of low-VOC and VOC-exempt solvents to remove a number of soils led to the inclusion of a solvent immersion test method in the MIL-PRF-32295A specification. In this method, polished stainless steel coupons (1×2×0.05 inch) are weighed, coated on one sided with 20-25 mg of soil, and re-weighed. Stained coupons are cyclically immersed and withdrawn from a 150-ml beaker containing 100 ml of the solvent at a rate of 20 cycles per minute for 5 minutes. The coupons are flash-dried at 140° F. (60° C.) for 5 minutes to prevent excess soil from being removed by gravity, cooled to room temperature, and re-weighed. Cleaning efficiency is determined gravimetrically as an average of three coupons in the same soil. This method is preferred because it produces reproducible results and allows a number of samples to be averaged to determine cleaning efficiency. Method 1 cleaning efficiency results are presented in Table 4.

TABLE 4

Results of Method 1 Immersion Cleaning Testing

| Solvent | Cleaning Efficiency (%) | St. Dev. |
|---|---|---|
| Hexane | 92.2 | 1.8 |
| MIBK | 98.7 | 0.4 |
| Base | 97.5 | 0.4 |
| Base 2 | 94.4 | 0.8 |
| Form 2.1 | 94.2 | 0.8 |
| Form 2.2 | 93.4 | 0.6 |
| Base 3 | 95.9 | 0.3 |
| Form 3.1 | 98.1 | 0.4 |
| Form 3.2 | 95.8 | 0.7 |
| Form 4.1 | 96.7 | 0.5 |
| Form 4.2 | 96.2 | 0.5 |
| Form 4.3 | 95.3 | 0.5 |

Method 2—Wipe (Swab) Cleaning

The wipe (swab) cleaning procedure for removing hydraulic fluid from composite material was developed by Tillman and Boswell in a previous study. The cleaning efficiency was evaluated based on the number of cotton swab wipe cycles needed to remove the entirety of the fluid contamination from the composite surface. In this method, 6×2×0.037 inch panels of IM7/977-3 are immersed in a beaker containing MIL-Prf-83282 hydraulic fluid for two weeks. Panels are removed, lightly wiped with Tech Wipe tissues, and hang-dried to the perpendicular for 24 hours at ambient temperature. Upon verification of hydraulic fluid presence by visual inspection, panels are cleaned by depositing 0.3 ml of solvent onto a cotton swab, cleaning a 1×1 inch area of the contaminated composite by wiping six times in one direction, and wringing the swab out into a glass vial. The surface is wiped, and the residue is deposited into the vial twice more. Three wipes with the same swab constitute one wash cycle. The solvent wrung-out from the swab is deposited onto a Potassium bromide salt plate and dried at 104° F. (40° C.) at 2 psi for 15 minutes. The salt disc is analyzed via infrared spectroscopy to indicate the presence of the hydraulic fluid residue on the surface. Additional cleaning cycles are performed until the infrared spectra show no hydraulic fluid presence.

Figure 2:
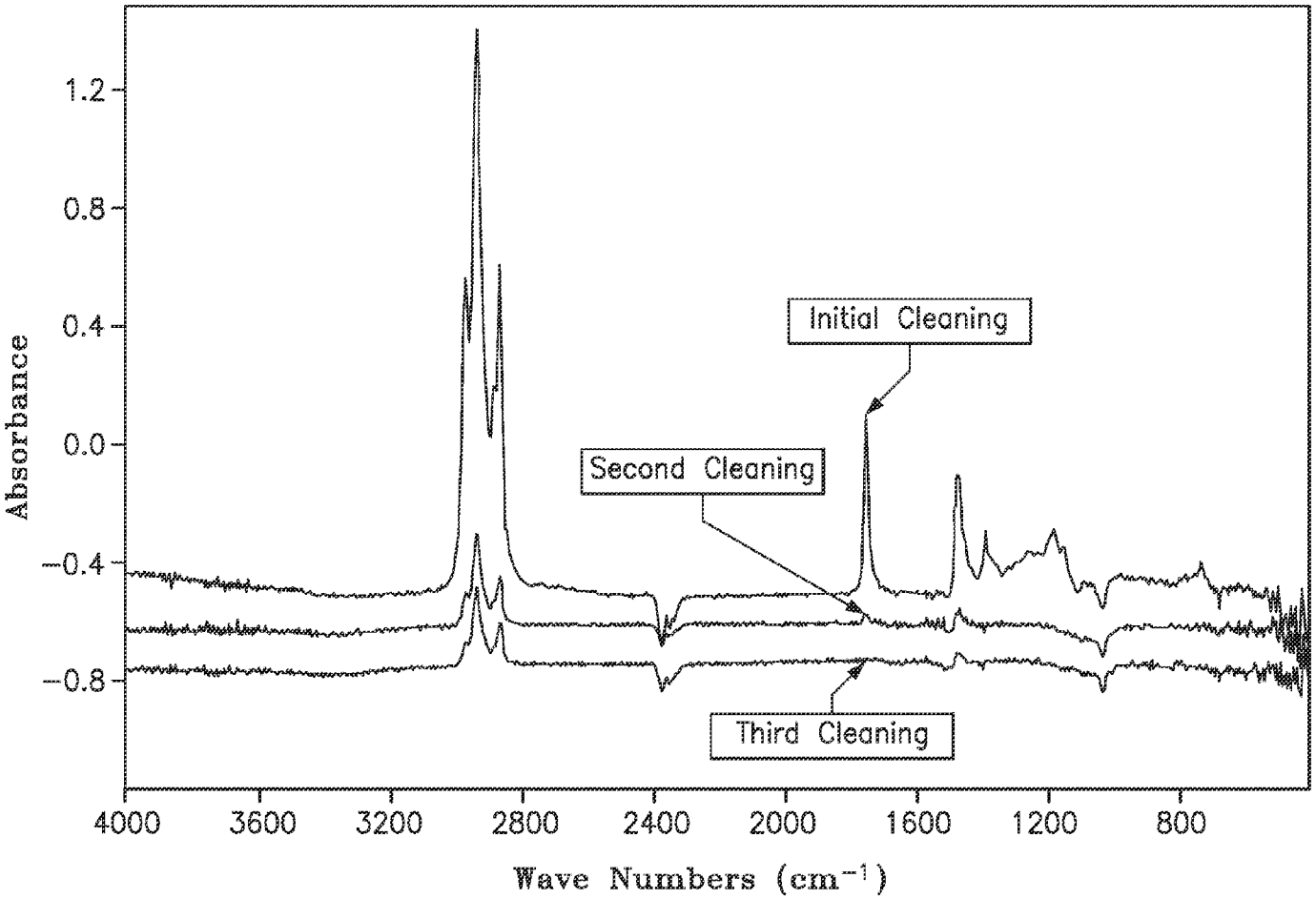
FIG. 2: Infrared spectra for the residue remaining after the initial, second and third cleaning for one of the solvents (swab method).

FT-IR is the analytical tool of choice to detect trace residual hydraulic fluid. A Nicolet model 550 Magna Ft-IR spectrometer was used with data collection by transmission through the sample deposited on the potassium bromide disc. All FT-IR background and sample spectra were collected using 32 scans with a special resolution of $cm^{-1}$. FIG. 1 shows the spectra for the contaminant hydraulic fluid (top) and a representative hydrocarbon solvent. The absorption at 1710-1740 $cm^{-1}$ range was identified as a differentiator between contaminant and solvent; this peak corresponds to the carbonyl stretching vibration from the dibasic ester in the MIL-PRF-83282 hydraulic fluid. FIG. 2 shows the decrease in peak height for successive cleaning cycles. This cleaning method is preferred because it is a better representation of the actual decontamination scenario, being fluid removal from composite material as opposed to stainless steel. Method 2 cleaning efficiency results are presented in Table 5.

TABLE 5

Results of Method 2 Cleaning Efficiency Testing

| Solvent | Trials |
|---|---|
| Hexane | 3 |
| MIBK | 5 |

TABLE 5-continued

| Results of Method 2 Cleaning Efficiency Testing | |
|---|---|
| Solvent | Trials |
| Base 2 | 3 |
| Form 2.1 | 3 |
| Base 3 | 3 |
| Form 3.1 | 3 |
| Form 4.1 | 2 |
| Form 4.2 | 2 |

Method 3—Composite Immersion Cleaning

In order to incorporate the benefits of the two existing test methods, the MIL-PRF-32295A cleaning efficiency procedure was modified to use IM7/977-3 composite panels. Other than the panel material, the only difference between this procedure and the MIL-PRF-32295A procedure is that the panels were dried at 248° F. (120° C.) and cooled to ambient immediately before using to ensure that all absorbed moisture had been driven off. Method 3 cleaning efficiency results are presented in Table 6.

TABLE 6

| Results of Method 3 Cleaning Efficiency Testing | | |
|---|---|---|
| Solvent | Cleaning Efficiency (%) | StDev |
| Hexane | 94.8 | 0.3 |
| MIBK | 97.1 | 0.3 |
| Base 2 | 96.9 | 0.2 |
| Form 2.1 | 97.1 | 0.3 |
| Base 3 | 99.1 | 0.1 |
| Form 3.1 | 99.1 | 0.3 |
| Form 4.1 | 98.9 | 0.1 |
| Form 4.2 | 99.5 | 0.3 |

Flash Point

To give indication that the flash points of developed solvents exceeded the NFPA 30 Class III lower limit of 140° F. (60° C.), testing was completed using Procedure B and a manual apparatus. The flash point for the optimized cleaner (formulation 4.2) was measured in accordance with ASTM D93 method and found as 141° F. degree.

Drying Time

Drying times for selected solvents were measured in accordance with MIL-PRF-32295A specification. One gram of solvent placed in an Aluminum weighing dish of 2 inch (5 cm) diameter and 0.6 inch (1.5 cm) depth and heated in an oven at 120° F. (49° C.) in 10-minute increments. After each increment, the dish was removed from the oven, cooled to ambient, weighed and re-placed in the oven. This procedure continued until the weight of the dish returned to its original weight, indicating that the solvent had dried off completely. Results for the drying time study are presented in Table 7.

TABLE 7

| Results of Drying Time Testing | |
|---|---|
| Solvent | Dry Cycles[a] |
| Hexane | 1 |
| MIBK | 1 |
| Base 2 | 3 |
| Form 2.1 | 4 |
| Base 3 | 5 |

TABLE 7-continued

| Results of Drying Time Testing | |
|---|---|
| Solvent | Dry Cycles[a] |
| Form 3.1 | 5 |
| Form 4.1 | 4 |
| Form 4.2 | 4 |

[a]Dry cycles is defined as the number of 10-minute heating cycles at 120° F. (49° C.) required to evaporate all solvent from the tray Residual Surface Contaminants Tape Peel Adhesion Testing Tape peel adhesion tests were performed in accordance with ASTM D 3330M-02

Method A to determine if the new solvent formulations deposited any residual surface contaminates on composite laminates after cleaning which might degrade bond strength. The performance of the new solvent formulations was compared to several currently utilized solvents (see Table 3). Both unexposed and hydraulic fluid saturated composite specimens were also tested as baseline controls. IM7/977-3 composite specimens were immersed in the cleaning fluids under test for 1 week at room temperature, removed, and dry-wiped once. The average results of these studies for each solvent are shown in Table 8.

TABLE 8

| Results of Peel Strength Testing after Condition Exposure | | |
|---|---|---|
| Condition | Peel Strength (lb ft/in) | StDev |
| No Exposure | 10.62 | 0.77 |
| Hydraulic Fluid | 2.50 | 0.42 |
| Hexane | 10.01 | 0.78 |
| MIBK | 11.38 | 0.19 |
| Base 2 | 9.74 | 0.61 |
| Form 2.1 | 10.04 | 0.68 |
| Base 3 | 10.19 | 0.40 |
| Form 3.1 | 9.89 | 0.49 |
| Form 4.1 | 10.68 | 0.33 |
| Form 4.2 | 10.48 | 0.42 |

Compression Lap Shear (CLS) Testing

The preliminary Compression Lap Shear results are shown in Table 9. Compared to the baseline IM7/977-3 panels which were not cleaned with Form 4.2, the cleaned panels which were not cleaned with Form 4.2, the cleaned panels showed significantly higher shear strengths. This was the case even for the unsanded sample compared to the baseline sanded specimen. The results indicate that Form 4.2 not only left no contamination residuals that would degrade the bond-line, but also increased the bond strength and decreased the measurement scatter compared to the controls.

TABLE 9

| Results for Compression Lap Shear Testing | | |
|---|---|---|
| Condition | Bond Strength (psi) | StDev |
| Unsanded | 6580 | 300 |
| Sanded | 6980 | 370 |
| Un-Sanded, Cleaned | 7467 | 83 |
| Sanded, Cleaned | 7515 | 73 |

Material Compatibility

Preliminary flexural strength and short beam shear tests were performed on IM7/977-3 specimens exposed to the new solvent formulations to demonstrate the mixtures do not degrade the mechanical properties of this specific composite material system. The flexural strength test was chosen as this measurement is sensitive to surface ply degradation. The 3-point bending moment during the test induces large in-plane compressive and tensile loads in the outer surfaces of the specimen. As such, the test is sensitive to any surface localized mechanical property knockdowns induced by the composites exposure to hydraulic fluid or cleaners. The short beam shear test was chosen as it is simple method for evaluating resin dominated, bulk property knockdowns in a composite laminate.

Flexural Strength Testing

The flexural strength properties of IM7/977-3 composite after exposure to the new solvent formulations were determined in accordance with ASTM D790. The solvent formulations evaluated are listed in Table 3. The composite test specimens were first conditioned by soaking in MIL-PRF-83282 hydraulic fluid for 1-week and 3-week periods followed by exposure to the test solvents for one hour. A solvent soak of one-hour was chosen as the maximum exposure time the composite would encounter in the field. This time was chosen as the next step in the part cleaning step is vacuum bagging and application of heat which will remove and residual solvent trapped in the composite. Five specimens at each condition were run for ASTM D790. The results of the Flexural Strength Testing are shown in Table 10.

TABLE 10

Results of Flexural Strength Testing

| Soak | No Solvent | | Hexane | | MIBK | | Form 3.1 | | Form 4.1 | | Form 4.2 | |
|---|---|---|---|---|---|---|---|---|---|---|---|---|
| Time | ksi | S.D. | ksi | S.D. | ksi | S.D. | ksi | S.D. | ksi | S.D. | ksi | S.D. |
| None | 132.4 | 9.1 | 136.7 | 7.9 | 137.6 | 9.3 | 137.1 | 5.3 | 138.4 | 6.5 | 138.2 | 6.1 |
| 1 Week | 142.2 | 5.6 | 143.4 | 7.4 | 142.6 | 4.0 | 138.1 | 11.7 | 141.7 | 3.9 | 137.4 | 5.1 |
| 3 Weeks | 135.2 | 6.5 | 136.5 | 6.7 | 139.7 | 5.8 | 133.0 | 7.0 | 138.9 | 3.8 | 136.8 | 8.4 |

Short Beam Shear Strength Testing

The short beam shear (SBS) properties of im7/9977-3 composite after exposure to the new solvent formulations were determined in accordance with ASTM D2344 (13). The composite test specimens were conditioned the same as described in Section 2.6.1 above. Ten SBS specimens were tested for each exposure condition. The results of the short beam shear strength testing are shown in Table 11.

TABLE 11

Results of Short Beam Shear Strength Testing

| Soak | No Solvent | | Hexane | | MIBK | | Form 3.1 | | Form 4.1 | | Form 4.2 | |
|---|---|---|---|---|---|---|---|---|---|---|---|---|
| Time | ksi | S.D. | ksi | S.D. | ksi | S.D. | ksi | S.D. | ksi | S.D. | ksi | S.D. |
| None | 7.7 | 0.9 | 8.3 | 1.1 | 7.3 | 0.5 | 7.4 | 0.4 | 7.6 | 0.3 | 7.7 | 0.8 |
| 1 Week | 7.3 | 0.7 | 7.6 | 0.6 | 7.8 | 0.7 | 7.1 | 0.3 | 7.58 | 0.7 | 7.5 | 0.4 |
| 3 Weeks | 7.8 | 0.8 | 7.3 | 0.5 | 7.6 | 0.5 | 7.2 | 0.4 | 7.5 | 0.5 | 7.2 | 0.3 |

This research was focused on developing an effective, safe, and environmentally friendly non-aqueous solvent cleaner to remove oleaginous materials such as hydraulic fluid from composite materials. Several formulations were developed from selected aliphatic, aromatic, oxygenated, fluorinated, and silanated solvents to meet the established properties and usage requirements of a "green" cleaning solution. The required properties include the following HAP-free, ODS-free, non-carcinogenic, high solvency, high flash point, low vapor pressure, and compatible with metals and non-metals.

Using multiple techniques, the cleaning efficiency of the optimized formulation (Formulation 4.2) was measured and found to be more effective than the control solvents (hexane and MIBK) currently authorized for use in the Navy maintenance depots. The effects of non-volatile residue on both room and elevated temperature composite-adhesive bonding were evaluated by the adhesive peel and compression lap shear tests. These preliminary results on the IM7/977-3 composite system indicate the lab formulations leave no contamination residue on the composite surface that degrades peel and lap shear strengths. This indicates that, while the formulated solvent dries slower than the two solvents currently in use, it does not present a contamination issue at the bond-line. The fluid sensitivity of the down-selected Form 4.2 formulation on IM7/977-3 mechanical properties was also evaluated. Preliminary flexural strength and short beam shear tests on IM7/977-3 specimens exposed to from 4.2 find no knockdown in these properties.

Future use of the 4.2 cleaner of this invention will permit compliance with current environmental regulations on cleaning solvents and will provide a user-friendly and more efficient cleaning solution for removal of oleaginous materials such as hydraulic fluid contamination from fiber composites. In addition, the solvent of this invention does not adversely affect the mechanical or the thermal properties of the composite and, as the cost to replace a composite part is ten times the cost to repair, the ability to more efficiently remove hydraulic fluid from these components and thus lower the bonded repair scrap rate would have a significant impact on Navy sustainment costs.

While a preferred embodiment of the invention has been described, it will be apparent to those skilled in the art that changes and modifications may be made without departing from the invention. The appended claims are therefore intended to cover changes and modifications that fall within the scope of the claimed invention.

We claim:

1. A non-aqueous solvent composition for cleaning and removing oleaginous materials from reinforced fiber composites characterized as being free of ozone depletion materials, having a low vapor pressure and a flash point above 140° F. and consisting essentially of from about 1.0 to 3.0 parts by weight of cyclohexenes, from about 45 to 55 parts by weight of isoparaffinic hydrocarbons, from about 45 to 55 parts by weight of dearomatized hydrocarbons and from 0.0 to 5.0 parts by weight of corrosion inhibitors.

2. The solvent composition of claim 1 wherein the fiber composites comprise graphite fibers reinforced with epoxy polymers.

3. The composition of claim 1 wherein the cyclohexenes ranges from about 1.5 to 2.5 parts by weight, the isoparaffinic hydrocarbons ranges from about 48 to 50 parts by weight, the dearomatized hydrocarbons ranges from about 48 to 50 parts by weight and the corrosion inhibitors ranges from about 1.0 to 3.0 parts by weight.

4. The composition of claim 1 wherein the corrosion inhibitors are selected from the group consisting of benzimidazole, benzothiazole, benzoxazole, diphenyltriazole, benzotriazole and tolylazole.

5. The composition of claim 1 wherein the oleaginous materials comprise hydraulic fluid.

6. Process for cleaning and removing oleaginous materials from a reinforced-fiber composite which comprises applying an effective amount of a non-aqueous solvent composition on and into said fiber composite and subsequently removing the oleaginous materials and the non-aqueous solvent composition from the composite; said non-aqueous solvent composition consisting essentially of from about 1.0 to 3.0 parts by weight of cyclohexenes, from about 45 to 55 parts by weight of isoparaffinic hydrocarbons, from about 45 to 55 parts by weight of dearomatized hydrocarbons and from 0.0 to 3.0 parts by weight of corrosion inhibitors.

7. The process of claim 6 wherein the fiber-reinforced composite comprises graphite fibers reinforced with polymeric materials.

8. The process of claim 6 wherein the non-aqueous solvent composition is an organic fluid characterized as being free of ozone depletion materials, having a low vapor pressure, a flash point above 140° F. and free of hazardous air pollutants.

9. The process of claim 8 wherein the non-aqueous solvent composition consist essentially of from about 1.0 to 3.0 parts by weight of cyclohexenes, from about 48 to 50 parts by weight of isoparaffinic hydrocarbons, from about 48 to 50 parts by weight of a dearomatized hydrocarbons and from about 1.0 to 3.0 parts by weight of corrosion inhibitors.

10. The process of claim 9 wherein the corrosion inhibitor is selected from the group consisting of benzimidazole, benzothiazole, diphenyltriazole, benzotriazole and tolylazole.

11. The process of claim 6 wherein the oleaginous material comprise an organic fluid.

12. The process of claim 11 wherein the organic fluid is a hydraulic fluid.

13. The process of claim 6 wherein the non-aqueous solvent composition consist essentially of solvents characterized as being free of ozone depletion materials, having a low vapor pressure, a flash above 140° F., free of hazardous pollutants and do not adversely affect the mechanical and thermal properties of the reinforced-fiber composite.

14. The process of claim 13 wherein an effective amount of the non-aqueous solvent composition is applied to said fiber composite by submerging the fiber-composite into solvent composition.

15. Process of cleaning and removing oleaginous materials from a reinforced-fiber composite which comprises removing the air from said composite, washing said composite with effective amounts of a non-aqueous solvent composition, consisting essentially of from about 1.0 to 3.0 parts by weight of cyclohexenes, from about 45 to 55 parts by weight of isoparaffinic hydrocarbons, from about 45 to 55 parts by weight of dearomatized hydrocarbons and from 0.0 to 3.0 parts by weight of corrosion inhibitors mixing said solvent composition with the oleaginous materials, removing the mixture of solvent composition and oleaginous materials from the fiber composite and subsequently drying the fiber composite in air.

16. The process of claim 15 wherein the fiber composite is washed by submerging the composite in the non-aqueous solvent composition.

17. The process of claim 15 wherein the mixture of solvent composition and oleaginous materials are removed from the fiber composite by pulling a vacuum.

18. The process of claim 15 wherein air is removed from the composite by pulling a vacuum.

19. The process of claim 15 wherein the oleaginous materials comprise hydraulic fluids.

* * * * *